US007883395B2

(12) United States Patent
Fang et al.

(10) Patent No.: US 7,883,395 B2
(45) Date of Patent: Feb. 8, 2011

(54) ELECTRICAL CONTACT STRUCTURES AND METHODS FOR USE

(75) Inventors: Rui Fang, Wappingers Falls, NY (US); Deepak Kulkarni, Wappingers Falls, NY (US); David K. Watts, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 551 days.

(21) Appl. No.: 11/947,103

(22) Filed: Nov. 29, 2007

(65) Prior Publication Data

US 2009/0142994 A1 Jun. 4, 2009

(51) Int. Cl.
*B23H 5/06* (2006.01)
*C25D 17/00* (2006.01)
*B24D 11/02* (2006.01)

(52) U.S. Cl. ..... 451/41; 204/297.1; 204/224 M; 204/212; 205/663

(58) Field of Classification Search ..... 451/41, 451/36–37, 526–539; 204/297.01, 297.1, 204/224 M, 280, 212; 205/663, 640
See application file for complete search history.

(56) References Cited

U.S. PATENT DOCUMENTS

| | | | | |
|---|---|---|---|---|
| 6,962,524 | B2 * | 11/2005 | Butterfield et al. | 451/526 |
| 7,066,800 | B2 * | 6/2006 | Chen et al. | 451/526 |
| 7,569,134 | B2 * | 8/2009 | Butterfield et al. | 205/662 |
| 2004/0020788 | A1 * | 2/2004 | Mavliev et al. | 205/640 |
| 2006/0180465 | A1 * | 8/2006 | Mavliev et al. | 204/297.1 |
| 2008/0102737 | A1 * | 5/2008 | Chang et al. | 451/56 |

* cited by examiner

*Primary Examiner*—Robert Rose
(74) *Attorney, Agent, or Firm*—Schmeiser, Olsen & Watts; Katherine Brown

(57) ABSTRACT

Methods and structures. A planarization method includes: providing a contact structure, where the contact structure includes an axle configured to rotate about an axis of rotation, a plurality of cantilever arms, each arm having a first end connected to the axle, where each arm extends radially outward from the axle; and a plurality of electrically conductive spheres, where at least one sphere is disposed on a second end of each arm; placing a substrate in contact with the spheres, applying an electric voltage to the axle, where the voltage transfers to the substrate, where responsive to the transfer an electrochemical reaction occurs on the substrate; rotating the axle, wherein the spheres revolve about the axis, wherein at least one sphere remains in electrical contact with the substrate; and electrochemical-mechanically planarizing the substrate. Also included is a contact structure, an electrical contact, and an electrical contact method.

7 Claims, 6 Drawing Sheets

ELECTRICAL CONTACT STRUCTURES AND METHODS FOR USE

FIELD OF THE INVENTION

The invention generally relates to electrical contact devices and electrochemical-mechanical planarization methods.

BACKGROUND OF THE INVENTION

Electrochemical mechanical planarization (eCMP) requires consistent and reliable anodic contact with the wafer during planarization. Present methods depend on the electrolytic flow rate to maintain anodic contact to the wafer, however, instabilities in the electrolyte flow rate may cause planarization rate instability and tool faults. In addition, present methods for anodic contact are plagued with voltage spikes which may cause post-CMP wafer defects such as hollow metals and/or unstable planarization rates. There exists a need for a method which provides consistent continuous and reliable electrical contact during planarization.

SUMMARY OF THE INVENTION

The present invention relates to a planarization method, comprising:

providing a contact structure, said contact structure comprising an axle, said axle having an axis of rotation, said axle configured to rotate about said axis of rotation; a plurality of cantilever arms, each cantilever arm of said plurality of cantilever arms having a first end and a second opposing end, said first end connected to said axle, said each cantilever arm extending radially outward from said axle about perpendicular to said axis of rotation; and a plurality of electrically conductive spheres, wherein at least one electrically conductive sphere of said plurality of electrically conductive spheres is disposed on said second end of each cantilever arm of said plurality of cantilever arms;

placing a substrate in contact with said plurality of electrically conductive spheres, wherein said substrate lies in a plane about perpendicular to said axis of rotation;

applying an electric voltage to said axle, said electric voltage transferring to said substrate, wherein responsive to said transferring an electrochemical reaction occurs on said substrate;

rotating said axle on said axis, wherein said plurality of electrically conductive spheres revolves about said axis, wherein at least one electrically conductive sphere of said plurality of electrically conductive spheres remains in electrical contact with said substrate during said rotating; and electrochemical-mechanically planarizing said substrate during said rotating.

The present invention relates to an electrical contact method, comprising providing an axle having an axis of rotation, a plurality of cantilever arms, each cantilever arm of said plurality of cantilever arms having a first end and a second opposing end, said first end connected to said axle, said each cantilever arm extending radially outward from said axle about perpendicular to said axis of rotation, and a plurality of electrically conductive contacts, wherein at least one electrically conductive contact of said plurality of electrically conductive contacts is disposed on said second end of each cantilever arm of said plurality of cantilever arms;

supporting a sample on a support member;

pressing said plurality of electrically conductive contacts against a first surface of said sample; and after said pressing, revolving said plurality of electrically conductive contacts about said axis of rotation, wherein said at least one electrically conductive contact of said plurality of electrically conductive contacts remains in electrical contact with said first surface.

The present invention relates to a contact structure comprising:

an axle, said axle having an axis of rotation, said axle configured to rotate about said axis of rotation;

a plurality of cantilever arms, each cantilever arm of said plurality of cantilever arms having a first end connected to said axle, said each cantilever arm extending radially outward from said axle about perpendicular to said axis of rotation; and a plurality of electrically conductive spheres, wherein at least one electrically conductive sphere of said plurality of electrically conductive spheres is disposed on a second end of each cantilever arm of said plurality of cantilever arms.

The present invention relates to an electrical contact, comprising:

an axle having a first axis of rotation, said axle configured to rotate about said axis;

a support arm having a first end attached to said axle, wherein said support arm extends radially outward from said axle about perpendicular to said first axis of rotation;

a contacting unit disposed on a second end of said support arm, said second end configured to support said contacting unit, wherein said contacting unit may freely rotate while being supported by said second end; and a retaining unit configured to secure said contacting unit to said second end, wherein said retaining unit is configured to allow said contacting unit to freely rotate while simultaneously being secured by said retaining unit and supported by said second end.

BRIEF DESCRIPTION OF THE DRAWINGS

The features of the invention are set forth in the appended claims. The invention itself, however, will be best understood by reference to the following detailed description of illustrative embodiments when read in conjunction with the accompanying drawings.

DETAILED DESCRIPTION OF THE INVENTION

Figure 1:
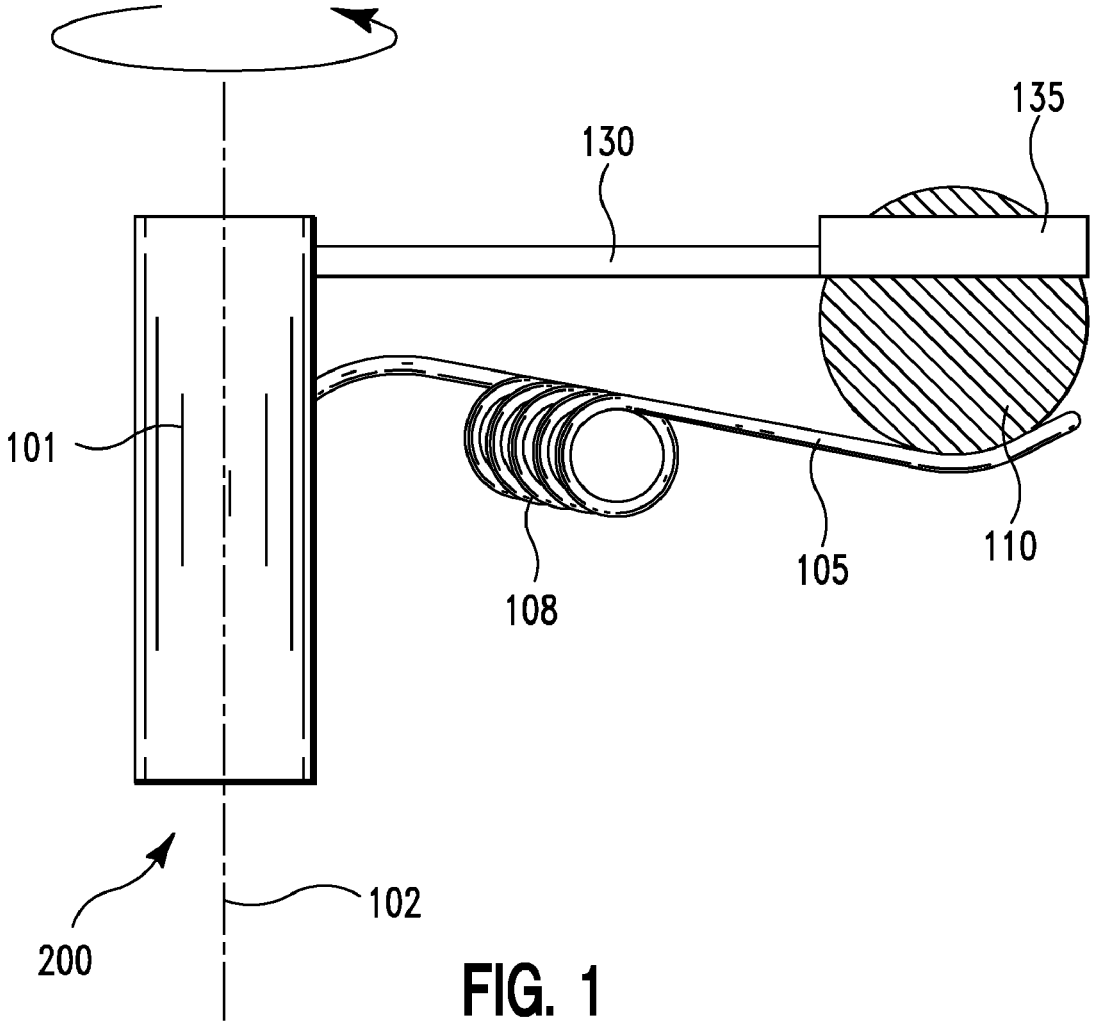
FIG. 1 is an illustration of an example of an embodiment of an electrical contact, in accordance with embodiments of the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as examples of embodiments. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

FIG. 1 is an illustration of an example of an embodiment of an electrical contact 200 comprising an axle 101 having an axis of rotation 102, where the axle 101 may be configured to rotate about the axis of rotation 102. The contact 200 may include a support arm 105 extending radially outward from the axle 101, the support arm 105 having two ends where a first end may be attached to the axle 101 such that the support arm 105 may be about perpendicular to both the axle 101 and the axis of rotation 102.

The electrical contact 200 may comprise a contacting unit 110 disposed on a second end of the support arm, where the second end of the support arm 105 may be configured to support the contacting unit 110 and allow the contacting unit 110 to freely rotate. For example, the second end of the support arm 105 may be cupped to match the shape of spherical contacting unit 110. The support arm 105 may comprise a cantilever arm as illustrated in the example of FIG. 1, but the support arm's configuration is not limited to a cantilever arm. For example, the support arm may have additional bracing which may provide support to the support arm 105 and support the contacting unit 110.

The contacting unit 110 may comprise electrically conductive materials, such as metals or conductive polymers. For example, the contacting unit 110 may comprise copper, titanium, tungsten, stainless steel, or a combination of these. In one embodiment, the contacting unit 110 may comprise a conductive or non-conductive material coated with a metal, such as a corrosion resistant metal. The use of a corrosion resistant metal may increase the useful lifetime of the contacting unit 110 by reducing or preventing corrosion to the electrically conductive surface of the contacting unit 110, as compared with a corrosion susceptible metal. The axle 101, the support arm 105, the retaining unit 130, and the contacting unit 110 may each be electrically conductive and may comprise electrically conductive materials.

The electrical contact 200 may comprise a retaining unit 130 configured to prevent removal of the contacting unit 110 and retain the contacting unit 110. For example, the contacting unit 110 may comprise a sphere where the retaining unit 130 may comprise a ring 135 having a diameter smaller than the diameter of the sphere. When the ring 135 is placed over and held against the sphere such that the sphere is simultaneously secured between the second end of the support arm 105 and the ring 135, the ring 135 prevents the sphere from being removed while the ring 135 may still allow for the free rotation of the sphere.

In an embodiment where the at least one contacting unit 100 is a sphere, free rotation may be described as the rotation of the sphere about a plurality of axes passing through the center of the sphere. In an embodiment where the contact structure 110 is a cylinder, free rotation may be described as rotation of the cylinder about an axis passing through the centers of the bases of the cylinder.

The support arm 105 may act as a spring. Such a configuration allows the support arm 105 to apply sufficient force to the contacting unit 110 to press the contacting unit 110 against the retaining unit 135 and hold the contacting unit 110 in place. For example, the entire length of the support arm 105 may act as a spring and may be comprised of a metal (such as spring steel, for example) having sufficient flexible and elastic properties to allow it to automatically return to about its original shape after being bent or strained. In another embodiment, at least one section of the support arm 105 may comprise a spring 108, such as a torsion spring or a coil spring, where the spring 108 may be configured to allow the support arm 105 to be reversibly and elastically bent or flexed as the spring 108 is strained.

Figure 2:
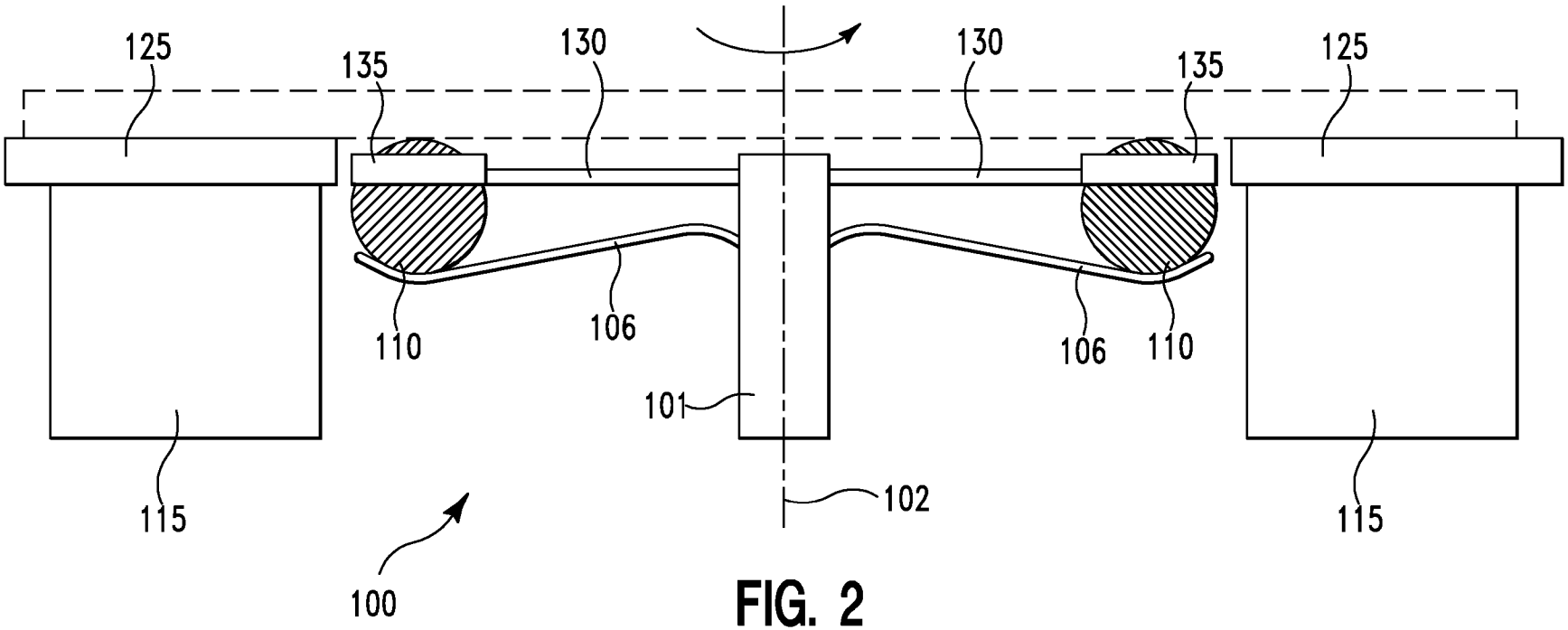
FIG. 2 is an illustration of an example of an embodiment of a contact structure, in accordance with embodiments of the present invention.

FIG. 2 is an illustration of an example of an embodiment of a contact structure 100 having an axle 101, where the axle 101 may have an axis of rotation 102, such that the axle 101 may be configured to rotate about the axis of rotation 102. The contact structure 100 may comprise a plurality of support arms 105, extending radially outward from the axle 101 and about perpendicular to the axis of rotation 102, where each support arm 105 has a first end connected to the axle 101. The axle 101 and the plurality of support arms 105 may be electrically conductive. At least one section of each support arm 105 may act as a spring, such as is described above.

The contact structure 100 may comprise a plurality of contacting units 110 such as those described above, where the contacting units 110 may be electrically conductive. At least one contacting unit 110 of the plurality of contacting units 110 may be disposed on a second end of each support arm 106 of said plurality of support arms 106. The plurality of contacting units 110 may comprise, for example, spheres, cylinders, the like, or a combination of these.

The contact structure 100 may comprise at least one retaining device 132 configured to retain or hold the contact structures 110 and to prevent removal or loss of the contact structures 110. For example, the plurality of contacting units 110 may comprise spheres where the retaining device 132 may comprise a ring 135 or plurality of rings 135 each having a diameter smaller than the diameter of each of the spheres. When the ring 135 is placed over and held against the sphere such that the sphere is simultaneously secured between the second end of the cantilever arm 106 and the ring 135, the ring 135 prevents the sphere from being removed while the ring 135 may still allow for the free rotation of the sphere. The retaining device 132 may be configured to retain a single contacting unit 110 or a plurality of contacting units 110, such as 2, 3, 4, 5, or 6 contacting units, for example.

The contact structure 100 may comprise at least one polishing pad 125 and at least one support platen 115. The support platen 115 may be configured to support a sample 120 pressed against the contacting units 110. The polishing pad 125 may be disposed between the sample 120 and the support platen 115. For example, the contact structure may comprise a polishing pad and platen such as are found in a system for electrochemical-mechanical planarization (eCMP) of semiconductor wafers. The sample may comprise any material or physical object to which electrical contact is desired. The sample may, for example, comprise a substrate (e.g., a layer or a laminate, a material, and the like) onto which materials may be deposited or adhered. For example, a sample or substrate may comprise materials of the IUPAC Group 11, 12, 13, and 14 elements; plastic material; silicon dioxide, glass, fused silica, mica, ceramic, metals, metals deposited on the aforementioned materials, combinations thereof, and the like. For example, a sample may comprise a dielectric coated silicon process wafer or a copper substrate such as those used in semiconductor manufacturing.

Figure 3:
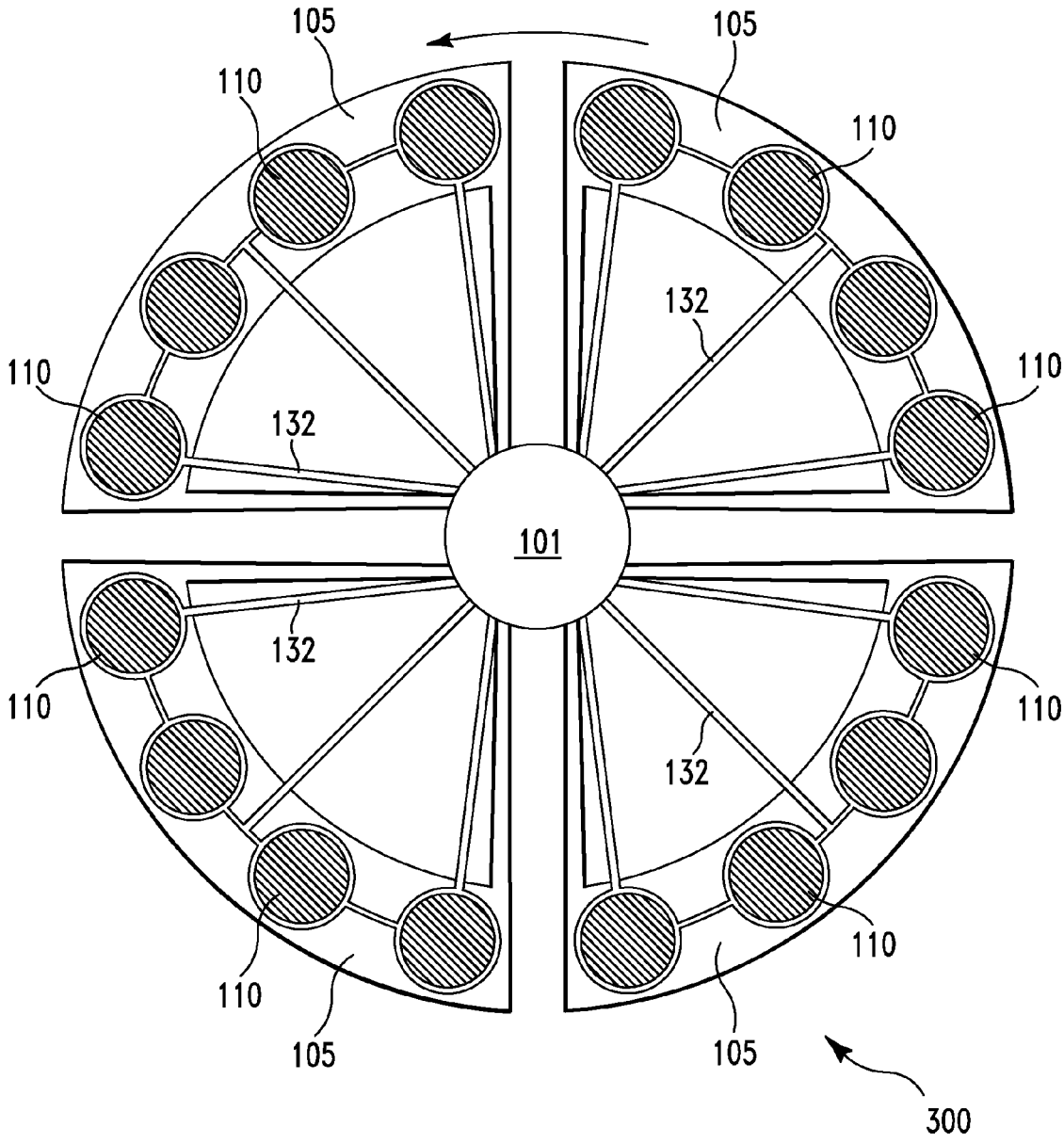
FIG. 3 is an illustration of a top view of an example of a contact structure, in accordance with embodiments of the present invention.

FIG. 3 is an illustration of a top view of an example of a contact structure 300 having a central axle 101, and a plurality of support arms 106 connected to the axle 101 and extending radially outward from the axle 101. The contact structure 300 may comprise a plurality of contact units 110 such as those described above, where the contact units 110 may be disposed on ends of each of the plurality of support arms 106. Each support arm 106 may be configured to support more than one contacting unit 110 such as four contacting units 110, as illustrated in the example of FIG. 3. The contact structure may comprise a retaining device 132 configured to retain or hold the contacting units 110 and prevent removal of the contacting units 110, such as described above. Each retaining device 132 may be configured to hold a single contacting unit 110 or a plurality of contacting units, such as four contacting units 110 as illustrated in the example of FIG. 2.

Figure 4:
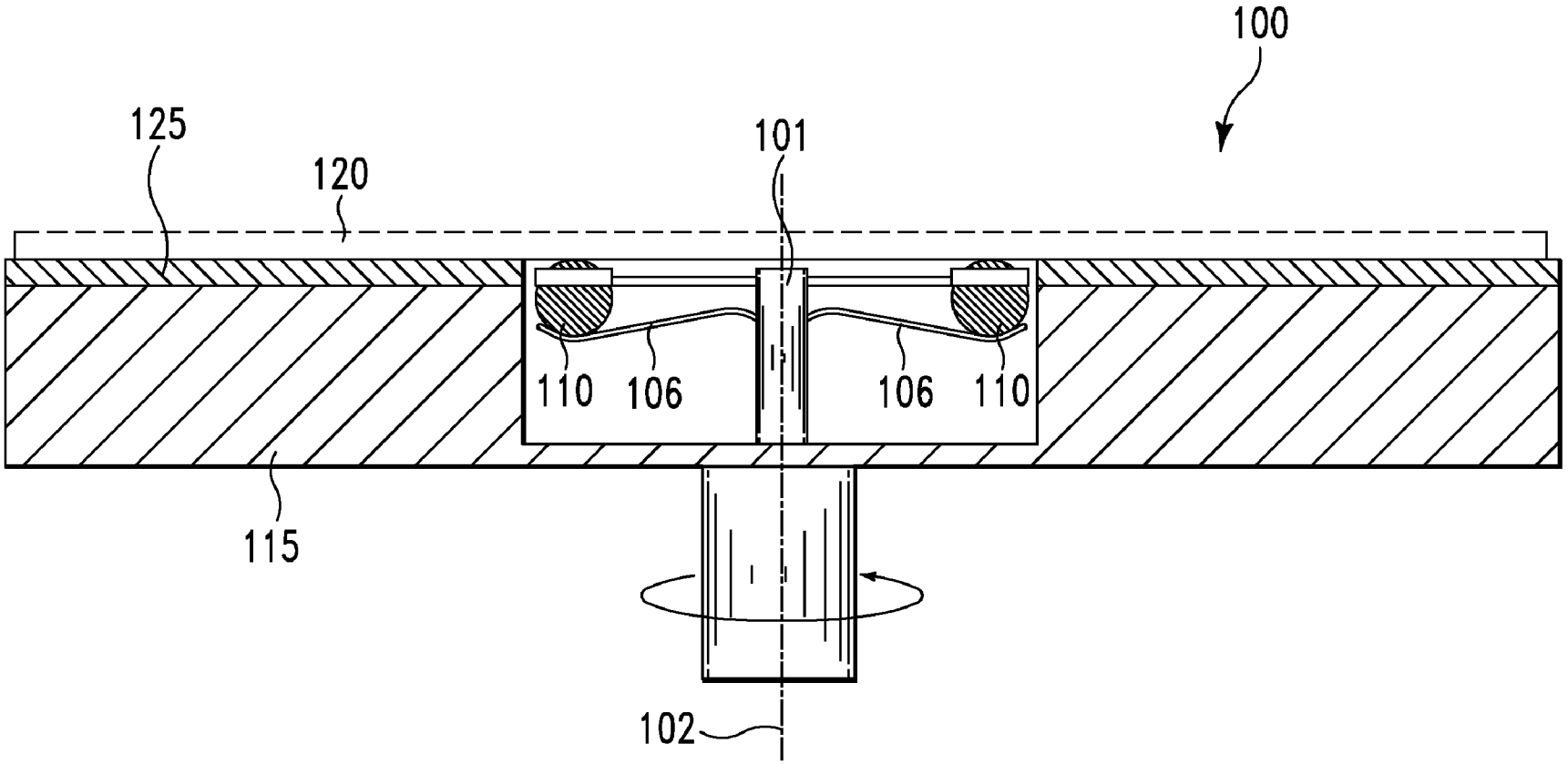
FIG. 4 is an illustration of an example of an embodiment of a contact structure, where the contact structure may be part of an electrochemical-mechanical planarization (eCMP) or chemical-mechanical planarization (CMP) system, in accordance with embodiments of the present invention.

FIG. 4 is an illustration of an example of an embodiment of a contact structure 100, where the contact structure 100 may be part of an electrochemical-mechanical planarization (eCMP) or chemical-mechanical planarization (CMP) system and may comprise a support platen 115 and a polishing pad 125. The axle 101 may be fixedly connected to the support platen 115, such that the axle 101 rotates with the platen 115 and polishing pad 125 as the platen 115 and polishing pad 125 rotate about an axis 102. The contacting units 110 may rotate as the axle 101 rotates and may provide continuous electrical contact to a sample 120 at the contacting units 110 are pressed against the sample 120 by the support arms 106. An electrical potential may be applied to the platen which may be transmitted through axle 101, plurality of support arms 106, and contacting units 110 to the sample 120 facilitating electrochemical mechanical planarization and accompanying electrochemical reactions on the sample. For example, where the sample is a copper process wafer, a cathodic potential may be applied to the platen and transferred to the copper wafer which acts as the anode. Electrochemical reactions during planarization may thus occur on the copper wafer such as:

$$Cu \rightarrow Cu^{n+} + ne^{-}$$

where n is an integer, facilitating the planarization of copper from the wafer surface.

Figure 5:
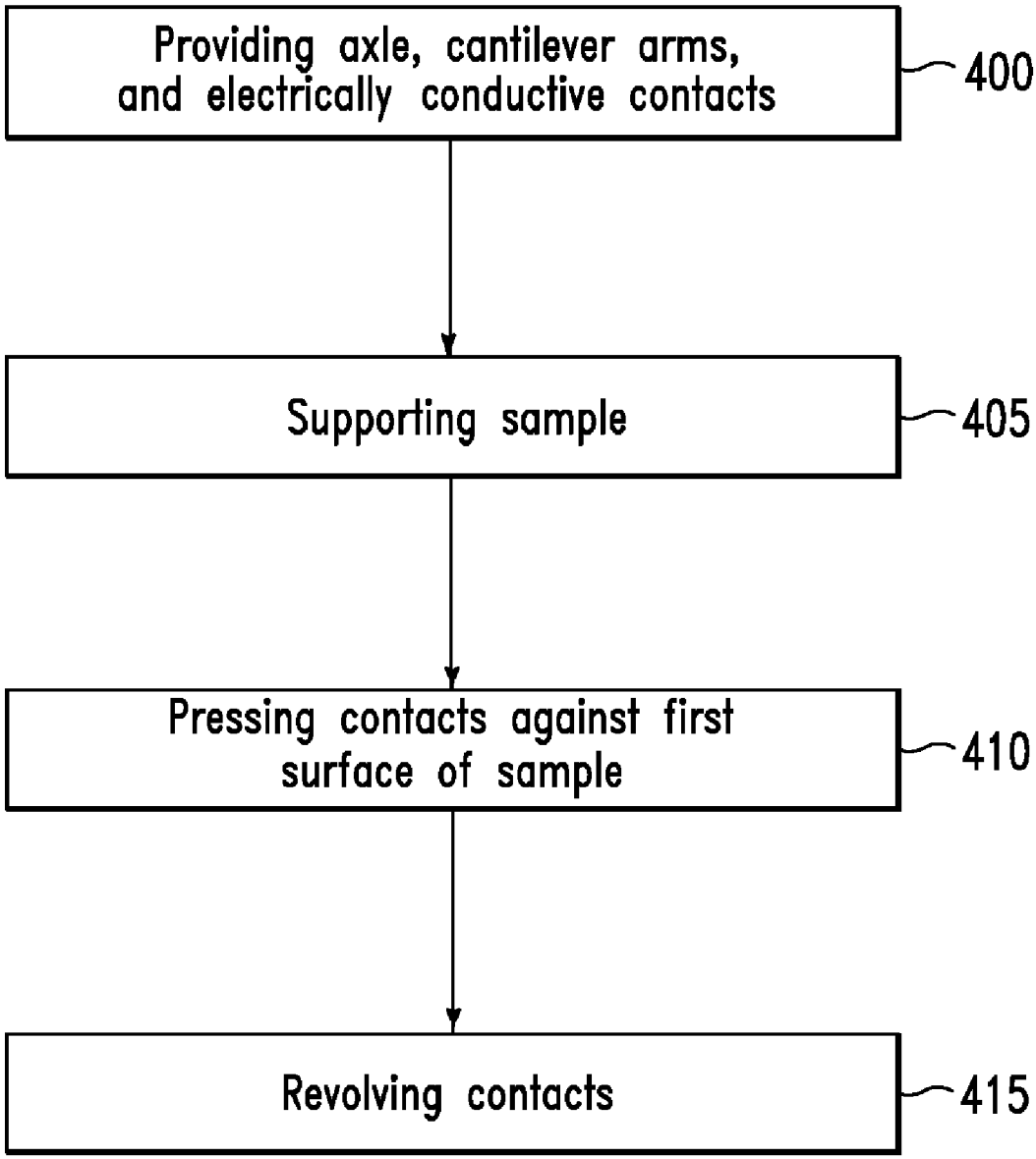
FIG. 5 is a flow chart illustrating an electrical contact method, in accordance with embodiments of the present invention.

FIG. 5 is a flow chart illustrating an electrical contact method. Step 400 provides an axle having an axis of rotation, a plurality of cantilever arms, each cantilever arm of said plurality of cantilever arms having a first end and a second opposing end, said first end connected to said axle, said each cantilever arm extending radially outward from said axle about perpendicular to said axis of rotation, and a plurality of electrically conductive contacts, wherein at least one electrically conductive contact of said plurality of electrically conductive contacts is disposed on said second end of each cantilever arm of said plurality of cantilever arms. The plurality of electrically conductive contacts may comprise spheres, cylinders, or a combination of these, and may comprise materials such as those described above for the contacting units 110 of FIG. 1, FIG. 2, FIG. 3, and FIG. 4.

In step 405 a sample is supported on a support member. The support member may comprise the combination of the support platen 115 and the polishing pad 125 illustrated in FIG. 2 and FIG. 4, for example.

In step 410, the electrically conductive contacts provided in step 400 are pressed against a first surface of the sample supported in step 405, such that the contacts are in direct electrical contact with the sample. The cantilever arms may apply an opposing force to sample pressed against the contacts, thus provided continuous electrical contact. For example, where at least one section of at least one cantilever arm comprises a spring, as discussed above, pressing the plurality of electrical contacts against the surface of the sample may exert a compressive force on the spring. In response, the spring may exert an opposing force, forcing the conductive contacts against the sample as the sample. The cantilever arms may be configured such that the force applied to the conductive contacts is sufficiently low enough that it does not damage the first surface of the sample, and sufficiently high enough to maintain contact with the first surface of the sample.

In step 415, the electrically conductive contacts are revolved about the axis of rotation, wherein at least one electrically conductive contact of said plurality of electrically conductive contacts remains in electrical contact with the first surface of the sample. For example, the axle may be rotated about the axis of rotation thus revolving the cantilever arms about the axis, and likewise revolving the conductive contacts disposed on the end of the cantilever arms. Continuous force applied to the first surface by the conductive contacts provides constant electrical contact between the conductive contact and the surface of the sample. An electric voltage or potential may be applied to the electrically conductive contacts. For example, an electric voltage or potential applied to an electrically conductive axle may be transmitted through a connection to an electrically conductive cantilever arm to an electrically conductive contact. An electric current may thus flow from the conductive spheres to the sample.

Figure 6:
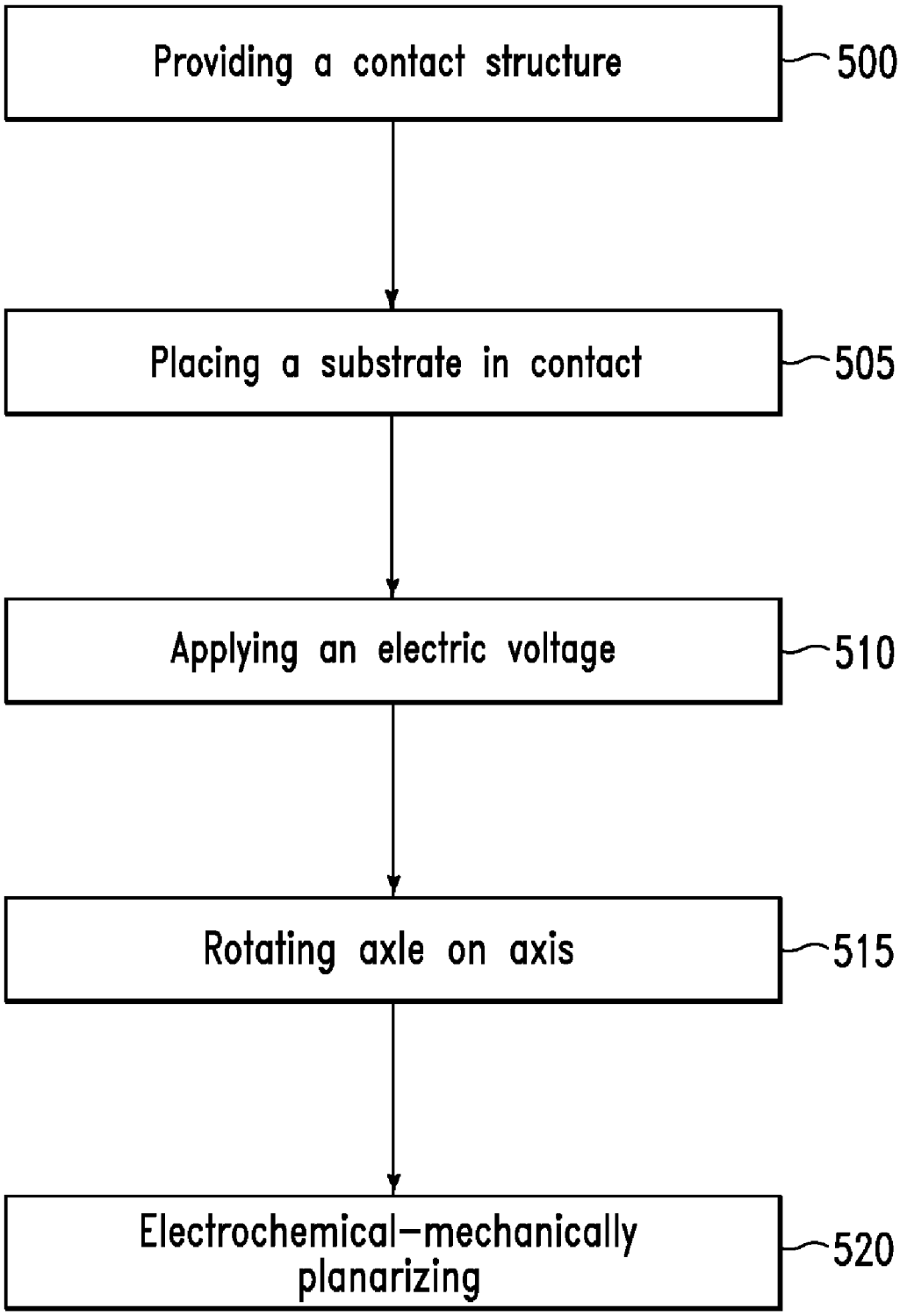
FIG. 6 is a flow chart illustrating a chemical-mechanical planarization method, in accordance with embodiments of the present invention.

FIG. 6 is a flow chart illustrating a planarization method. Step 500 provides a contact structure, such as is described above. The contact structure may comprise an axle having an axis of rotation, where the axle may be configured to rotate about the axis of rotation. The contact structure may comprise a plurality of cantilever arms, each having a first end and a second opposing end. The first end may be connected to the axle such that each cantilever arm extends radially outward from the axle about perpendicular to the axis of rotation and to the axle. The contact structure may comprise a plurality of electrically conductive units, such as spheres, where at least one electrically conductive unit is disposed on the second end of each cantilever arm of the plurality of cantilever arms.

In step 505 a substrate is placed in contact with the plurality of electrically conductive spheres. The substrate may lie in a plane about perpendicular to the axis of rotation. The substrate may comprise a material such as materials of the IUPAC Group 11, 12, 13, and 14 elements; plastic material; silicon dioxide, glass, fused silica, mica, ceramic, metals deposited on the aforementioned materials, combinations thereof, and the like. For example, a sample may comprise a dielectric coated silicon process wafer such as those used in semiconductor manufacturing.

In step 510 an electric voltage is applied to the axle, where responsive to applying the current, electric current flows from the axle, through at least one cantilever arms of the plurality of cantilever arms, through the electrically conductive spheres, and to the substrate. As a result of applying the electric voltage, electrochemical reactions may occur on the substrate.

In step 515 the axle is rotated on the axis, wherein the plurality of electrically conductive spheres revolves about the axis, wherein at least one electrically conductive sphere of the plurality of electrically conductive spheres remains in electrical contact with the substrate. As described above, each of the cantilever arms may act as a spring and may thus press the conductive sphere against the substrate and maintain electrical contact and allow current to continuously flow to the substrate. By revolving the plurality spheres about the axis, the contact between the conductive spheres and the substrate may constantly be adjusted such that if one contact point becomes resistive (such as due to corrosion or contamination), a second contact point may be made as each sphere freely rotates in contact with the substrate and thus maintains electrical contact with the substrate.

In step 520, the substrate is electrochemical-mechanically planarized while electrical contact is being maintained with the contact structure by simultaneously planarizing while revolving the spheres as in step 515 and applying the voltage as in step 510.

The foregoing description of the embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

What is claimed:

1. A planarization method, comprising:

providing a contact structure, said contact structure comprising an axle, said axle having an axis of rotation, said axle configured to rotate about said axis of rotation; a plurality of cantilever arms, each cantilever arm of said plurality of cantilever arms having a first end and a second opposing end, said first end connected to said axle, said each cantilever arm extending radially outward from said axle about perpendicular to said axis of rotation; and a plurality of electrically conductive spheres, wherein at least one electrically conductive sphere of said plurality of electrically conductive spheres is disposed on said second end of each cantilever arm of said plurality of cantilever arms;

placing a substrate in contact with said plurality of electrically conductive spheres, wherein said substrate lies in a plane about perpendicular to said axis of rotation;

applying an electric voltage to said axle, said electric voltage transferring to said substrate, wherein responsive to said transferring an electrochemical reaction occurs on said substrate;

rotating said axle on said axis, wherein said plurality of electrically conductive spheres revolves about said axis, wherein at least one electrically conductive sphere of said plurality of electrically conductive spheres remains in electrical contact with said substrate during said rotating; and electrochemical-mechanically planarizing said substrate during said rotating.

2. The method of claim 1, wherein said contact structure further comprises a polishing pad and a support platen, wherein said support platen supports said substrate and said polishing pad is disposed between said substrate and said platen.

3. The method of claim 1, wherein said substrate comprises a semiconductor wafer.

4. The method of claim 1, wherein each electrically conductive sphere of said plurality of electrically conductive spheres freely rotates about at least one axis passing through a center point of said each electrically conductive sphere during said rotating said axle.

5. The method of claim 1, wherein at least one section of each cantilever arm of said plurality of cantilever arms comprises a spring configured to force at least one electrically conductive sphere of said plurality of electrically conductive spheres against said sample.

6. The method of claim 1, wherein said plurality of electrically conductive spheres comprise a metal selected from the group consisting of copper, titanium, tungsten, and combinations thereof.

7. The method of claim 1, wherein said plurality of electrically conductive spheres comprise a material coated with a corrosion resistant metal.

* * * * *